US010494892B2

(12) United States Patent
Makowiecki et al.

(10) Patent No.: US 10,494,892 B2
(45) Date of Patent: Dec. 3, 2019

(54) MULTIFUNCTION DOWNHOLE PLUG

(71) Applicant: Halliburton Energy Services, Inc., Houston, TX (US)

(72) Inventors: Gary Joe Makowiecki, Spring, TX (US); Todd Anthony Stair, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 9 days.

(21) Appl. No.: 15/546,493

(22) PCT Filed: Mar. 26, 2015

(86) PCT No.: PCT/US2015/022723
§ 371 (c)(1),
(2) Date: Jul. 26, 2017

(87) PCT Pub. No.: WO2016/153521
PCT Pub. Date: Sep. 29, 2016

(65) Prior Publication Data

US 2018/0023362 A1 Jan. 25, 2018

(51) Int. Cl.
*E21B 33/12* (2006.01)
*E21B 34/10* (2006.01)
(Continued)

(52) U.S. Cl.
CPC ..... *E21B 33/12* (2013.01); *E21B 34/14* (2013.01); *E21B 34/10* (2013.01); *E21B 2034/007* (2013.01)

(58) Field of Classification Search
CPC ..... E21B 33/12; E21B 33/08; E21B 33/10; E21B 33/14; E21B 33/16; E21B 33/05; E21B 33/124
See application file for complete search history.

(56) References Cited

U.S. PATENT DOCUMENTS 4,941,535 A 7/1990 Porter et al.
5,413,172 A 5/1995 Laurel
(Continued)

FOREIGN PATENT DOCUMENTS

WO 2009/097341 A2 8/2009

OTHER PUBLICATIONS

International Search Report and Written Opinion issued in related PCT Application No. PCT/US2015/022723 dated Dec. 10, 2015, 12 pages.

(Continued)

*Primary Examiner* — David J Bagnell
*Assistant Examiner* — Manuel C Portocarrero
(74) *Attorney, Agent, or Firm* — John W. Wustenberg; Baker Botts L.L.P.

(57) ABSTRACT

A downhole plug and method of activating multiple downhole tools in a subterranean formation are disclosed. The plug includes a detachable ring that enables the plug to land in and engage at least two different seats, each seat having a different profile. This in turn enables the plug to activate at least two separate downhole devices, one in an upper downhole tool and one in a lower downhole tool. The ring separates from the plug once a certain pressure is reached in the wellbore enabling the plug to travel downhole from the upper tool to the lower tool to activate the device in the lower downhole tool.

20 Claims, 7 Drawing Sheets

(51) Int. Cl.

| | |
|---|---|
| ***E21B 34/00*** | (2006.01) |
| ***E21B 33/05*** | (2006.01) |
| ***E21B 33/124*** | (2006.01) |
| ***E21B 34/14*** | (2006.01) |

(56) References Cited

U.S. PATENT DOCUMENTS

| | | | | |
|---|---|---|---|---|
| 9,523,258 | B2 * | 12/2016 | Turley | E21B 17/028 |
| 2002/0139529 | A1 | 10/2002 | Fraser, III et al. | |
| 2013/0112434 | A1 | 5/2013 | Lende et al. | |

OTHER PUBLICATIONS

International Preliminary Report on Patentability issued in related PCT Application No. PCT/US2015/022723, dated Sep. 26, 2017, 8 pages.

* cited by examiner

MULTIFUNCTION DOWNHOLE PLUG

CROSS-REFERENCE TO RELATED APPLICATION

The present application is a U.S. National Stage Application of International Application No. PCT/US2015/022723 filed Mar. 26, 2015, which is incorporated herein by reference in its entirety for all purposes.

TECHNICAL FIELD

The present disclosure relates generally to plugs for downhole cementing and other completion operations, and, more particularly, to a plug capable of performing multiple functions downhole.

BACKGROUND

Hydrocarbons, such as oil and gas, are commonly obtained from subterranean formations that may be located onshore or offshore. The development of subterranean operations and the processes involved in removing hydrocarbons from a subterranean formation typically include a number of different steps such as, for example, drilling a wellbore at a desired well site, treating the wellbore to optimize production of hydrocarbons, and performing the necessary steps to produce and process the hydrocarbons from the subterranean formation.

The steps of completing the well, including well stimulation, well enhancement, zonal isolation, sand control, and other completion steps often use tubular downhole tools to perform a variety of functions. These downhole tools are often operated with a ball or plug. The plug or ball lands and seals on a sleeve or seat internal to the tool, allowing pressure to be generated. The pressure build up enables the sleeve or seat to slide from one position to another position. The sleeve or seat can thus move from a closed position to an open position, whereby casing ports are opened, thus allowing fluids to flow into the annulus or subterranean formation. Downhole plugs are a fairly simple and generally reliable means of activating downhole tools.

One of the drawbacks of downhole plugs, however, is that after a particular downhole operation has been performed, the plug needs to be moved out of the way to continue operations. One technique for doing this involves drilling the plug out of the downhole tool. Another technique involves pumping fluid downhole at such a high pressure that the plug is forced down and sometimes out of the downhole tool.

Recent develops have led to efforts to optimize the use of the downhole plugs, for example, by reusing them in subsequent wellbore operations. Such efforts include designing the seats that the plugs set into to shear at high pressures. This enables the plugs to travel downhole for subsequent use. This solution, however, is less than optimal because there are a number of restrictions within the casing, including the inner diameter of the casing itself and coupling transitions, which can interfere with the dislodged seats.

The present disclosure is directed to a multi-function plug, which includes a detachable member, which enables the plug to engage with at least two seats to perform at least two separate downhole operations. By employing a detachable member, the plug have a reduced outer diameter, which enables to continue downhole with minimal chance of forming an obstruction.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the disclosure.

Figure 1:
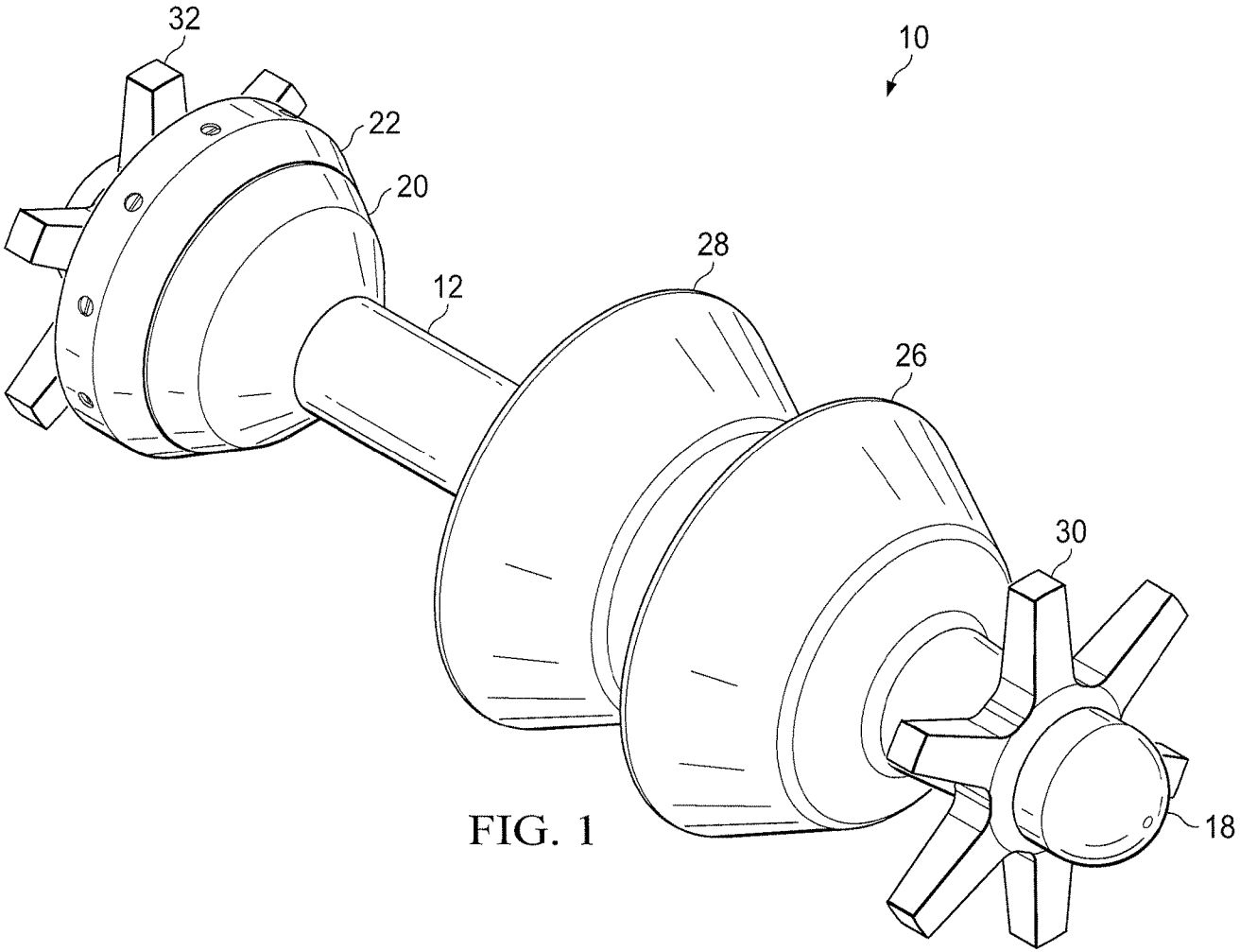
FIG. 1 is an isometric view of a plug in accordance with the present disclosure.
Figure 3:
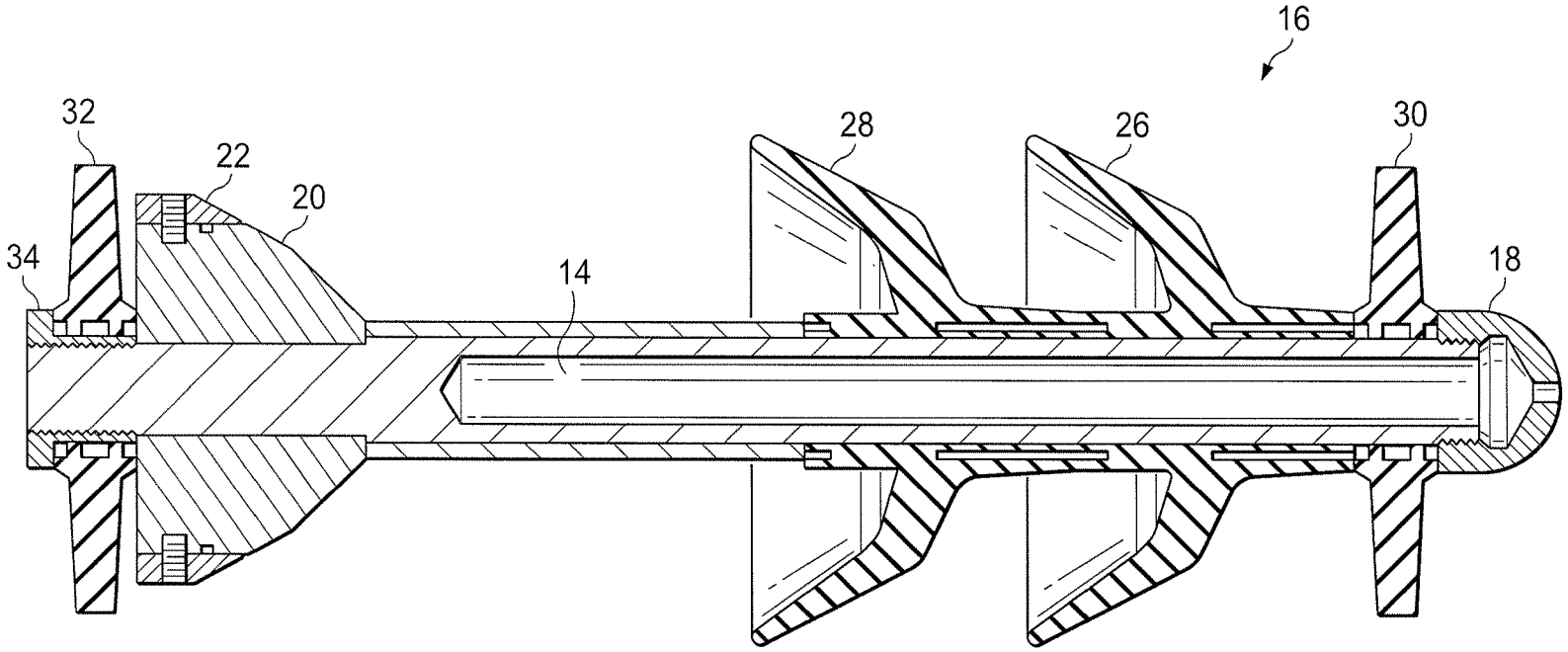
FIG. 3 is cross-sectional view of the plug shown in FIG. 1.
Figure 4:
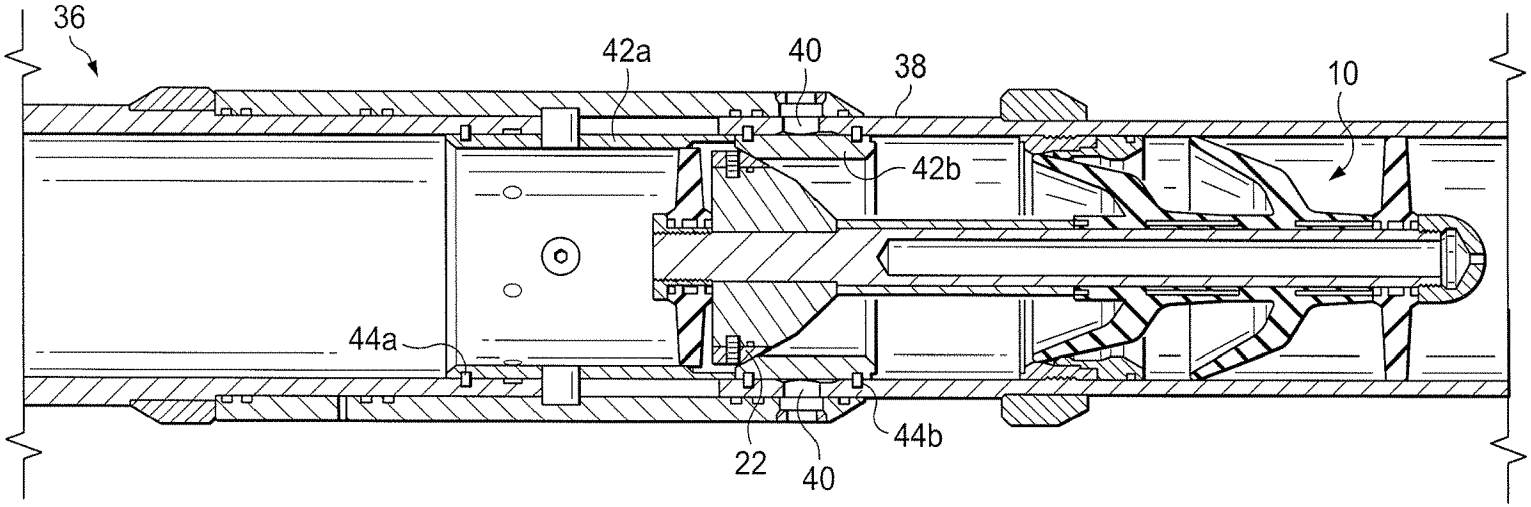
FIG. 4 is a partial cut-away view of an upper tool seated with the plug shown in FIG. 1 taken along a longitudinal plane.
Figure 5:
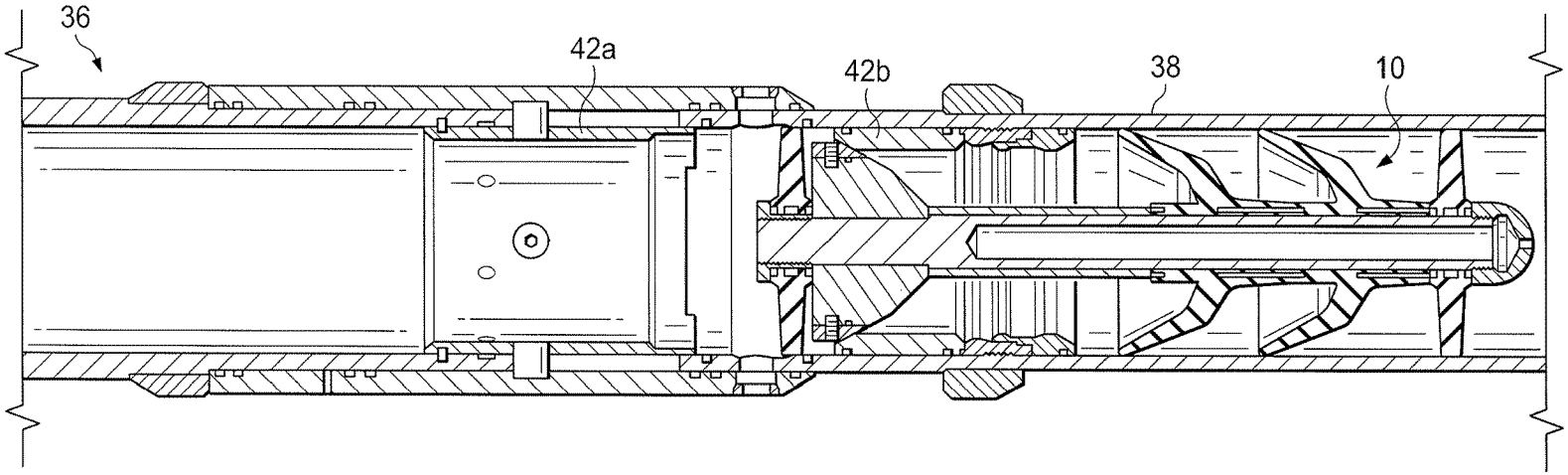
FIG. 5 is a partial cut-away view of the upper tool shown in FIG. 4 illustrating the plug shifting the tool from a closed position to an open position.

A multi-function downhole plug 10 in accordance with the present disclosure is shown in FIG. 1. The plug 10 is defined by a main body portion 12, which is generally tubular shaped. The main body portion 12 of the plug has a center bore section 14 which is hollow along approximately ⅔rds of the length of the main body 12, as shown in FIG. 3. The hollow section opens at the tip or nose of the plug 16. A cap 18 is placed at the tip or nose 16 of the plug 10. The cap 18 covers the open end of the main body 12 and prevents fluids and other downhole elements from entering into the hollow portion of the plug 10. The cap 18 may be formed of an elastomeric or other suitable material known to those of ordinary skill in the art. The main body 12 may be formed of any suitable material which can withstand the harsh downhole environment, such as, for example, a metal alloy or rigid thermoplastic material.

Figure 2:
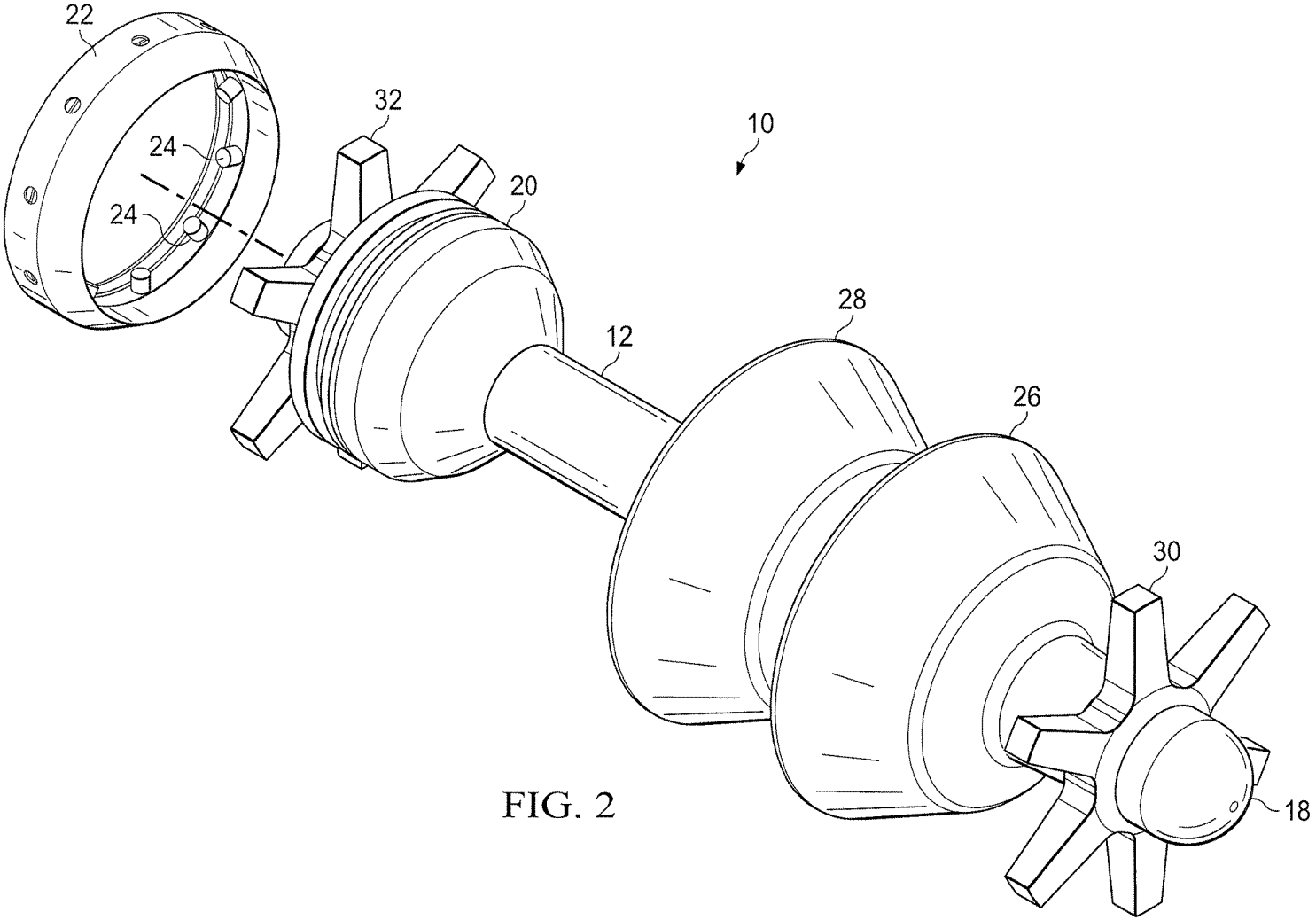
FIG. 2 is an isometric view of the plug shown in FIG. 1 illustrating separation of a shear ring from the body of the plug (with the pins shown intact for clarity)

The plug 10 is further defined by a hub 20, which is attached to the distal end of the main body 12, with the tip 16 being at the proximal end as a point of reference. The hub 20 has the shape of some car tire hubs, namely, generally circular with a forward taper, as best illustrated in FIGS. 1-2. The forward taper allows the hub 20 to have generally aerodynamic shape in the rear portion of the plug 10 thereby enabling it to move through casing or work string with minimal resistance. The main body 12 of the plug has a slightly smaller diameter at the distal end to enable the hub 20 to be secured over the distal end of the main body, as illustrated in FIG. 3. The hub 20 can be secured to the main body 12 using known mounting techniques, including, but not limited to welding, cementing, and the like. The hub 20 may be formed of the same material used to form the main body 12, but alternatively, may be formed of a different material, for example, a less rigid material.

The hub 20 has a generally flat section at its distal end which enables a ring 22 to be secured to it. The ring 22 has a greater diameter than the largest diameter portion of the hub 20, which is at the distal end. The ring 22 is secured to the end of the hub 20 may any one of a variety of known attached means. In one exemplary embodiment, the ring 22 is secured to the distal end of the hub using a plurality of shear pins 24 equally disposed around the circumferential surface of the ring 22 and hub 20. In the exemplary embodiment illustrated in FIGS. 1-3, ten shear pins 24 are illustrated. Those of ordinary skill in the art will understand and be able to determine the optimum number of shear pins to use, and their optimum size and grade, depending upon the particular application that the plug 10 will be used in. The ring 22 may be formed of the same material used to form the hub 20 and/or main body portion 12. The ring 22 also has a generally cylindrical shape with a forward facing taper, as best illustrated in FIG. 2. The forward facing taper is employed to continue the aerodynamic shape of the hub 20 at its distal end where the ring 22 is attached. As will be explained further below, the ring 22 enables the plug 10 to engage itself in at least two different downhole seats, which in turn enables the plug 10 to carry out at least two separate downhole operations. Furthermore, as those of ordinary skill in the art will appreciate, a plurality of nested rings 22 may be utilized with each layer of nested rings shearing off from the previous layer as downhole functions are performed. Thus, more than two downhole operations can be performed if multiple rings 22 are utilized.

The downhole plug 10 may have other optional features common among downhole plugs. For example, the downhole plug 10 may further include one or more wiper cups 26 and 28 as illustrated in FIGS. 1-3. The wiper cups 26 and 28 are known in the art and are used to wipe the inner walls of the casing string as the plug 10 is deployed downhole. In particular, the wiper cups 26 and 28 may be used to wipe the casing ID of mud cake and other debris. They can also be used as a mechanical separator between two separate and distinct types of fluid being pumped downhole, e.g., mud and cement. The wiper cups 26 and 28 have a generally cylindrical shape with a forward facing taper, which like the forward facing taper on the hub 20 and ring 22, enhance the aerodynamics of the plug 10 has a travels through one or more fluids downhole. The wiper cups 26 and 28 are generally formed of an elastomeric or rubber material, but can be formed of other suitable flexible materials which can withstand downhole conditions as well as have the ability to flex to conform to the non-uniform profile encountered by the plug 10 as it travels downhole.

An additional optional feature that the plug 10 may include are centralizers. FIGS. 1-3 shown two centralizers, one secured to the proximal end 30 and another secured to the distal end 32. As those of ordinary skill in the art, one or more or no centralizers may be employed depending upon the applications. The specific centralizers 30 and 32 that are illustrated, are generally star-shaped and have six equally spaced arms. Again, the number of arms used may be varied. The centralizers 30 and 32 aid in maintaining the plug in a generally centralizer axial position as the travels downhole. This helps to minimize the possibility that the plug 10 may get stuck in an undesirable location. The centralizers 30 and 32 may be formed of a suitable elastomeric or similar material, which can withstand downhole conditions, but also have enough rigidity to allow maintain the plug 10 in a centralized orientation. The proximal centralizer 30 is held in place onto the main body 12 by the elastomeric end cap 18. It may also be cemented or otherwise bonded to the main body 12 to ensure it does not separate from the main body. Likewise, the end cap 18 may be bonded to the tip 16 of the main body 12. Similarly, the distal centralizer 32 is held in place onto the distal end of the plug 10 by an elastomeric distal end cap 34, as best shown in FIG. 3. The distal centralizer 32 and end cap 34 may also be bonded to the main body 12 using a cement or other similar bonding agent.

With reference to FIGS. 4-7, the present disclosure will now discuss how the multi-function downhole plug 10 may operate. The plug 10 is deployed downhole through a section of casing string 36 until it reaches a section of the casing string identified as upper tool 38, shown in FIG. 4. The upper tool 38 is a section of the casing string which performs a downhole function, for example, injecting downhole fluid into the wellbore and/or formation through ports 40. The plug 10 lands in a two part seat 42*a* and 42*b*. Seat 42*a* may also be referred to as a closing seat and seat 42*a* may also be referred to as an opening seat 42*b*. Seats 42*a* and 42*b* are both secured to the inner circumferential surface of the upper tool 38 using a plurality of shear pins 44*a* and 44*a*, respectively. Shear pins 44*a* and designed to withstand higher shear forces than shear pins 44*b*.

The plug 10 lands in seat 42*b* wherein ring 22 of the plug engages with and seals against a tapered end of the opening seat. Fluid is substantially blocked from flowing downhole by the seal formed between the ring 22 of the plug and the tapered end of opening seat 42*b*. As the fluid is continued to be pumped downhole, pressure builds up. Upon reaching a high enough pressure the shear pins 44*b* shear, thereby causing opening seat 42*b* to slide downward to a position whereby the ports 40 are no longer cover the opening seat 42*b*. In this position, fluids pumped from the surface are allowed to be injected into the wellbore and/or subterranean formation. At a later time another plug (not shown) can be sent downhole to seat with closing seat 42*a* so as to activate the shearing of pins 44*a* and thereby slide closing seat 42*a* into a position whereby the ports 40 are once again blocked, i.e., into a position whereby the flow of fluid into the wellbore and/or subterranean formation is closed.

Figure 6:
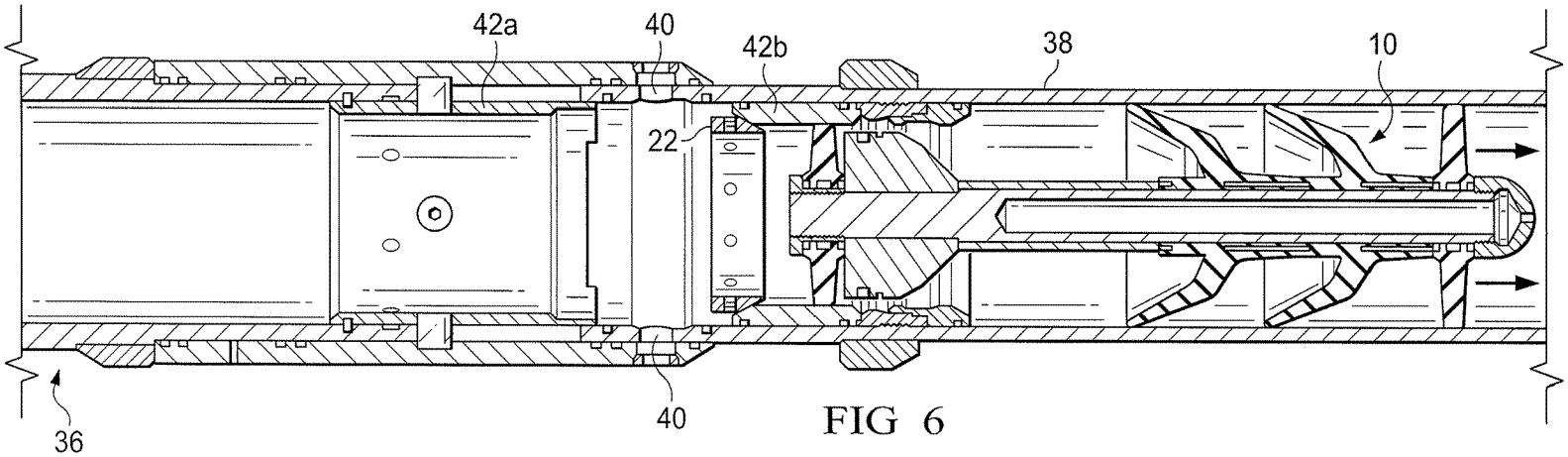
FIG. 6 is a partial cut-away view of the upper tool of FIG. 4 shown in the open position with only the shear ring of the plug remaining in the seat.

In the next step, after the plug 10 has activated the opening seat 42*b* into position, the plug 10 may be moved further downhole for subsequent operation. This can be accomplished by increasing the pressure of the fluid being pumped downhole so as to cause the shear pins 24 attaching the ring 22 to the hub 20 to fail. Upon shearing of the pins 24, the ring 22 will separate from the hub 20 and remaining part of the plug 10. This enables the plug 10 to continue traveling downhole for subsequent use is activating another downhole tool. Once the ring 22 separates from the plug 10, it remains engaged with the tapered portion of opening seat 42*b*. More specifically, the generally tapered/concave shape of the ring 22 allows the fluid being pumped downhole to force the ring into engagement with the tapered portion of the opening seat 42*b*. FIG. 6 illustrates the condition where the plug 10 has separated from the ring 22 and forced downhole leaving the ring engaged in the opening seat 42*b*.

Figure 7:
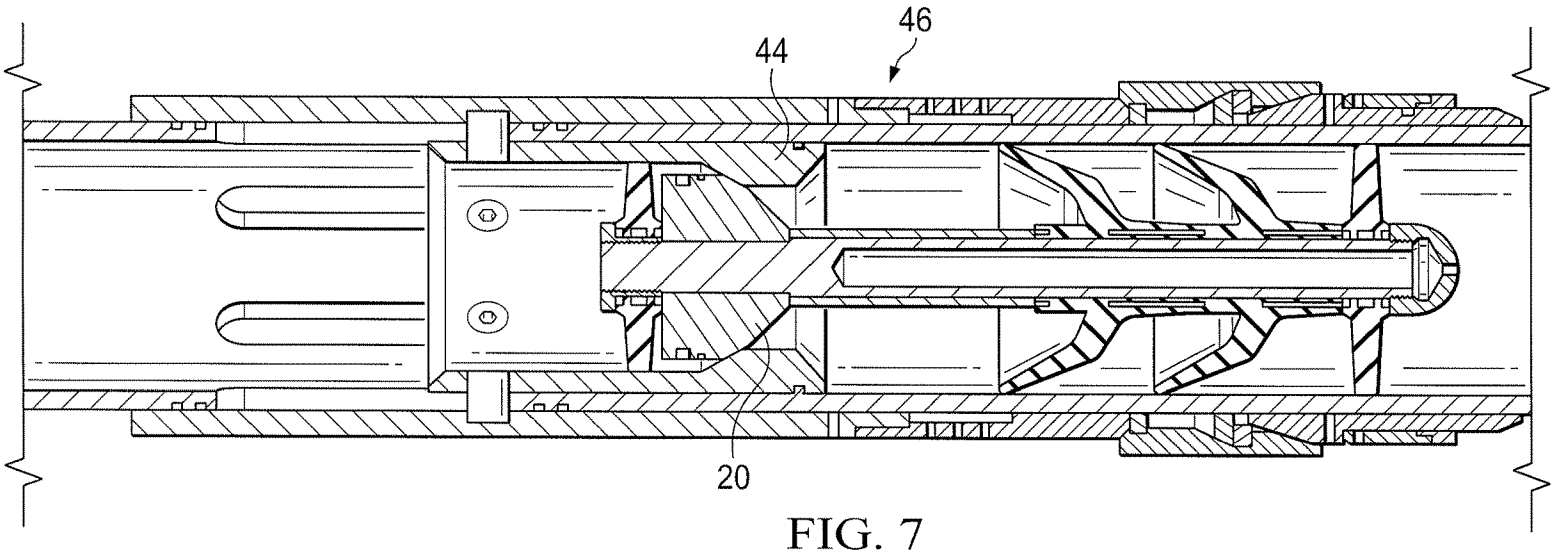
FIG. 7 is a partial cut-away view showing the plug seated in a lower tool.

Once the plug 10 separates from the ring 22 and moves further downhole it eventually engages with a seat 44 attached to a lower tool 46, as shown in FIG. 7. In particular, the hub 20 engages with a tapered inner surface of the seat 44 to form a seal between the seat 44 and plug 10. The seal formed between the seat 44 and the hub 20 of the plug 10 blocks the flow of fluid further downhole. As the fluid is continued to be pumped under this blocked condition, pressure builds up enabling the plug 10 and/or seat 44 to activate an operation of the lower tool 46. The seat 44 may optionally be a moveable sleeve. Once the downhole operation of the lower tool 46 has completed, the plug 10 may be removed, or in the case where the lower tool 46 is at the end of the casing string, the plug 10 may simply remain in place. There are a number of ways to remove the plug 10, which are known in the art, including but not limited to drilling out the plug, and utilizing a degradable material.

Although the present disclosure and its advantages have been described in detail, it should be understood that various changes, substitutions and alterations can be made herein without departing from the spirit and scope of the disclosure as defined by the following claims.

What is claimed is:

1. A downhole plug, comprising:

a main body having a first end and a second end;

a nose coupled to the main body at the first end;

a hub coupled to the main body proximate to the second end;

a detachable member coupled to a distal end of the hub, wherein the detachable member comprises a ring, and wherein the detachable member enables the downhole plug to engage with a first cylindrical seat and a second seat; and wherein the hub is engageable with the first cylindrical seat attached to a downhole tool to form a first seal between the first cylindrical seat and the downhole plug so as to perform a first operation, and wherein the ring is detachable from the hub such that the downhole plug is engageable with the second seat to form a second seal between the second seat and the downhole plug so as to perform a second operation.

2. The downhole plug according to claim 1, wherein the ring comprises a plurality of nested rings, and wherein a second ring of the plurality of nested rings is detachable from the downhole plug, and wherein the downhole plug is engageable with a third seat when the second ring detaches from the downhole plug.

3. The downhole plug according to claim 1, further comprising a plurality of shear pins that attach the ring to the hub.

4. The downhole plug according to claim 1, further comprising at least one wiper member coupled to the main body proximate the nose; the at least one wiper member being generally cup-shaped and formed of an elastomeric material.

5. The downhole plug according to claim 1, further comprising at least one centralizer member coupled to the main body.

6. The downhole plug according to claim 5, further comprising a first centralizer member coupled to the main body proximate to the first end and a second centralizer coupled to the main body proximate the second end.

7. The downhole plug according to claim 6, wherein the first and second centralizer members are generally star-shaped and formed of an elastomeric material.

8. The downhole plug according to claim 1, wherein the main body is formed of an aluminum alloy and has a partially hollow interior.

9. The downhole plug according to claim 1, wherein the second seat is installed in an upper downhole tool.

10. The downhole plug according to claim 9, wherein the first cylindrical seat having a smaller diameter than the second seat.

11. A method of activating multiple downhole tools in a subterranean formation, comprising:

(a) deploying a plug having a main body, a hub coupled to the main body, and a detachable member coupled to a distal end of the hub into a wellbore, wherein the detachable member comprises a ring, and wherein the detachable member enables the downhole plug to engage with a first cylindrical seat and a second seat;

(b) engaging the detachable member with the first seat formed in an upper downhole tool so as to perform a first operation;

(c) pumping fluid into the downhole tool to a pressure which causes the main body of the plug and the hub to separate from the detachable member;

(d) deploying the plug to a lower downhole tool; and (e) engaging the hub with a second seat formed in the lower downhole tool to form a second seal between the second seat and the downhole plug by detaching the ring of the detachable member from the hub so as to perform a second operation.

12. The method according to claim 11, further comprising pumping fluid into the wellbore tool when the plug is engaged in the first seat in the upper downhole tool to a pressure that causes activation of a device within the upper downhole tool.

13. The method according to claim 12, further comprising pumping fluid into the wellbore when the plug is engaged in the second seat in the lower downhole tool to a pressure that causes activation of a device within the lower downhole tool.

14. The method according to claim 13, wherein the devices in the upper and lower downhole tools each include a slidable sleeve.

15. The method of claim 11, wherein the ring comprises a plurality of nested rings, and wherein a second ring of the plurality of nested rings detaches from the plug by shearing a plurality of shear pins that attach the second ring to the plug so that the plug engages with a third seat.

16. The method of claim 11, wherein the wellbore is cased and the plug is deployed within the casing of the wellbore.

17. The method of claim 16, wherein the plug further comprises a plurality of wiper cups that wipe an inner surface of the casing as the plug is deployed down the wellbore.

18. The method of claim 11, wherein the plug further comprises at least one centralizer that centers the plug within the wellbore as the plug is deployed down the wellbore.

19. The method of claim 18, wherein the plug comprises a first centralizer at one end of the plug and a second centralizer at a second end of the plug.

20. The method of claim 11, further comprising the step of pumping fluid down the wellbore to a pressure that causes the plug to separate from the second seat formed in the lower downhole tool.

* * * * *